US011124373B2

(12) United States Patent
Moya Rojo et al.

(10) Patent No.: US 11,124,373 B2
(45) Date of Patent: Sep. 21, 2021

(54) SHEET MEDIA PROCESSING MACHINES WITH RE-FEED PREVENTION ELEMENTS

(71) Applicants: Hewlett-Packard Development Company, L.P., Houston, TX (US); Oscar Moya Rojo, Sant Cugat del Valles (ES); Javier Onecha, Sant Cugat del Valles (ES); Andreu Oliver, Sant Cugat del Valles (ES); Dorkaitz Alain Vazquez, Sant Cugat del Valles (ES); Nuria Fabregat, Sant Cugat del Valles (ES); Felix Ruiz Martinez, Sant Cugat del Valles (ES)

(72) Inventors: Oscar Moya Rojo, Sant Cugat del Valles (ES); Javier Onecha, Sant Cugat del Valles (ES); Andreu Oliver, Sant Cugat del Valles (ES); Dorkaitz Alain Vazquez, Sant Cugat del Valles (ES); Nuria Fabregat, Sant Cugat del Valles (ES); Felix Ruiz Martinez, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 329 days.

(21) Appl. No.: 15/760,557

(22) PCT Filed: Jan. 21, 2016

(86) PCT No.: PCT/EP2016/051265

§ 371 (c)(1),
(2) Date: Mar. 15, 2018

(87) PCT Pub. No.: WO2017/125160

PCT Pub. Date: Jul. 27, 2017

(65) Prior Publication Data

US 2020/0239246 A1 Jul. 30, 2020

(51) Int. Cl.
*B65H 1/04* (2006.01)
*B65H 1/26* (2006.01)
(Continued)

(52) U.S. Cl.
CPC ..... *B65H 1/04* (2013.01); *B65H 29/52* (2013.01); *B65H 1/266* (2013.01); *B65H 5/38* (2013.01);
(Continued)

(58) Field of Classification Search
CPC .... B65H 1/04; B65H 1/266; B65H 2405/332; B65H 2405/3321; B65H 2405/3322;
(Continued)

(56) References Cited

U.S. PATENT DOCUMENTS 4,904,100 A 2/1990 Enix
5,061,097 A 10/1991 Piatt
(Continued)

FOREIGN PATENT DOCUMENTS

JP 08324863 12/1996
JP 2003182903 A 7/2003

OTHER PUBLICATIONS

Shuttleworth Integrated Product Solutions, Printing & Binding, 3 pages. Feb. 5, 2016. URL: http://www.shuttleworth.com/products/printing-binding-conveyors/.

*Primary Examiner* — Luis A Gonzalez
(74) *Attorney, Agent, or Firm* — HP Inc. Patent Department

(57) ABSTRACT

There is disclosed a sheet media processing machine comprising a media inlet to receive sheet media along a feed direction from a first side of the machine and a media outlet to discharge sheet media along a discharge direction towards the first side of the machine. There is a feed mechanism to convey sheet media from the media inlet to the media outlet,
(Continued)

and a re-feed prevention element disposed upstream of the media inlet with respect to the feed direction to inhibit recirculation of discharged sheet media along an external recirculation path between the media outlet and the media inlet. The re-feed prevention element is exposed to contact with sheet media and comprises an elastomer. There is also disclosed a feed guide comprising a re-feed prevention element, and a method in which such a feed guide is installed on a sheet media processing machine.

12 Claims, 4 Drawing Sheets

(51) Int. Cl.
*B65H 29/52* (2006.01)
*B65H 5/38* (2006.01)

(52) U.S. Cl.
CPC ..... *B65H 2407/21* (2013.01); *B65H 2801/06* (2013.01); *B65H 2801/12* (2013.01); *B65H 2801/39* (2013.01)

(58) Field of Classification Search
CPC B65H 29/52; B65H 2801/39; B65H 2801/12; B65H 2801/06; B65H 2407/21; B65H 5/38; B65H 2405/112; B65H 2405/1122; B65H 2405/1118; B65H 2404/693
See application file for complete search history.

(56) References Cited

U.S. PATENT DOCUMENTS

| | | | | |
|---|---|---|---|---|
| 5,954,325 | A * | 9/1999 | Nagao | B65H 3/126 271/184 |
| 5,975,516 | A | 11/1999 | Maruchi et al. | |
| 6,027,111 | A * | 2/2000 | Rubscha | B65H 1/04 271/123 |
| 2008/0265490 | A1 * | 10/2008 | Hendrix | B65H 3/0684 271/117 |
| 2008/0290580 | A1 | 11/2008 | Connors et al. | |
| 2009/0179376 | A1 | 7/2009 | Ogasawara et al. | |
| 2013/0321883 | A1 | 12/2013 | Fernandez et al. | |

* cited by examiner

SHEET MEDIA PROCESSING MACHINES WITH RE-FEED PREVENTION ELEMENTS

BACKGROUND

Some scanners, multi-function printers and other types of sheet media processing machines are provided with media inlets and outlets on the same side of the machine to receive and discharge sheet media respectively. This may enable a user to conveniently feed sheet media into the machine and subsequently retrieve it after processing. In some examples, sheet media may comprise paper, cardboard, plastics or the like, which may be relatively flexible.

BRIEF DESCRIPTION OF DRAWINGS

Examples will now be described, by way of non-limiting example, with reference to the accompanying drawings, in which.

DETAILED DESCRIPTION

Figure 1:
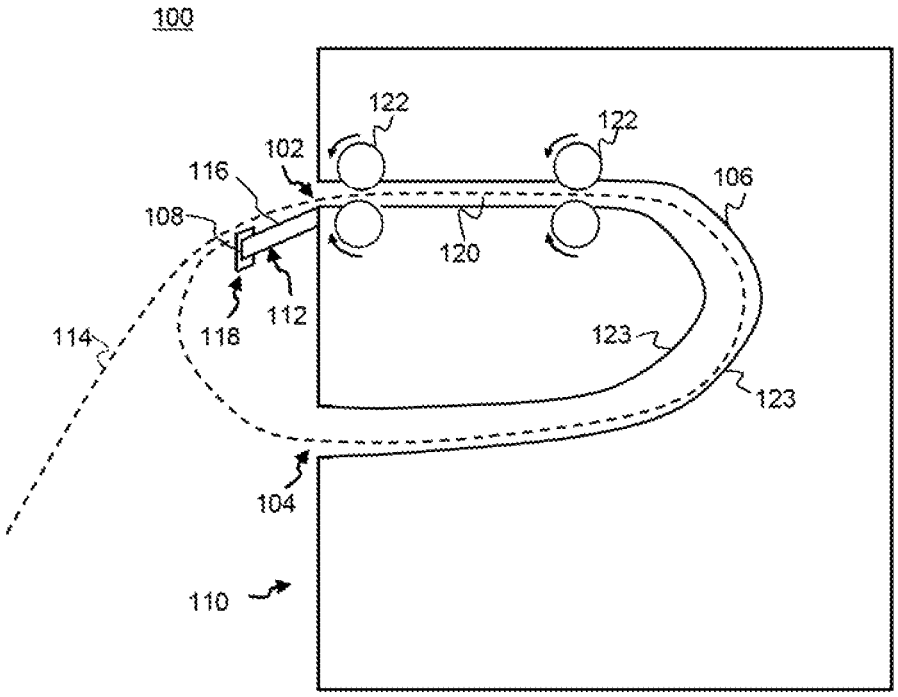
FIGS. 1 and 2 are simplified schematics of an example sheet media processing machine.
Figure 2:
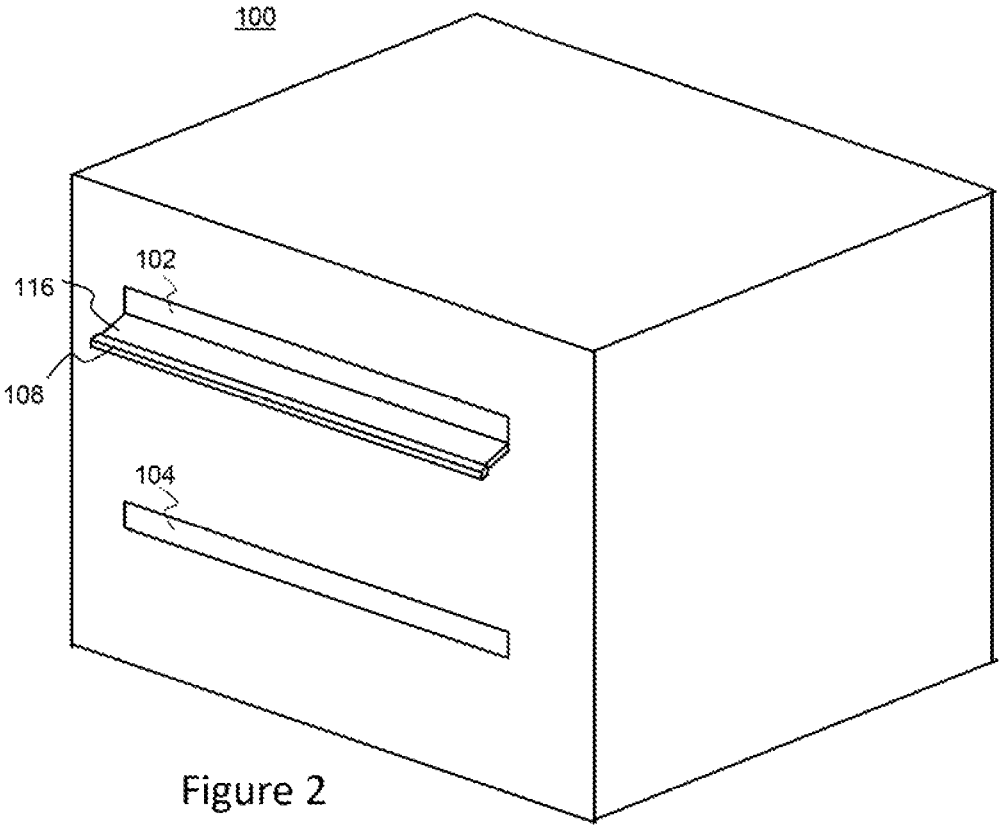

FIGS. 1 and 2 show an example sheet media processing machine 100, such as a printer, scanner or photocopier, comprising a media inlet 102, media outlet 104 and a feed mechanism 106 extending between the media inlet 102 and the media outlet 104. The media inlet 102 receives sheet media along a feed direction, and a re-feed prevention element 108 comprising an elastomer is disposed upstream of the media inlet 102 with respect to the feed direction.

The media inlet 102 and the media outlet 104 are disposed on the same first side 110 of the machine, which may enable a user to load sheet media for processing by the machine, and subsequently retrieve the sheet media in a convenient manner. For example, the first side 110 of the machine may be a front side of the machine. The media inlet 102 is disposed above the media outlet 104. Because the media inlet 102 and the media outlet 104 are located on the same first side 110 of the machine, there is an external recirculation path between the media outlet 104 and the media inlet 102 along which sheet media discharged from the media outlet 104 may curl towards the media inlet 102. In this example the feed direction extends towards the media inlet from the first side of the machine (from left to right in FIG. 1) and is inclined upwardly over the feed guide, for example, by an angle of up to 30° above the horizontal. In this example the discharge direction extends away from the machine towards the first side of the machine (from right to left in FIG. 1) and is substantially horizontal at the media outlet. Accordingly, in this example, the feed direction and discharge direction have opposing lateral components. The path of a particular discharge portion of sheet media away from the media outlet may depend on whether it tends to curl, for example along a recirculation path towards the media inlet.

In previously considered media processing machines in which a media inlet and media outlet are provided on the same side of the machine, a discharged portion of sheet media may curl towards the media inlet along such an external recirculation path, and may be drawn back in towards the media inlet by contact with a feed portion of sheet media, which may be a portion of the same piece of sheet media. This may result in recirculation of the discharged media, and consequently jamming of the machine that may damage the machine and/or the media (which may be a valuable original when the machine is a scanner or copier). Such recirculation may be more likely to occur when the sheet media is prone to curling, and may occur despite the presence of guards or deflectors extending from the machine between the media outlet and media inlet, particularly when the sheet media is relatively thick. Such guards or deflectors of previously considered machines may project significantly in front of a media inlet, and may have sharp edges.

In the example sheet media processing machine 100 of FIGS. 1 and 2, a re-feed prevention element 108 is provided upstream of the media inlet 102 with respect to the feed direction so that it is exposed to contact with sheet media. In this example, the re-feed prevention element 108 comprises an elastomer material. In this particular example, the re-feed prevention element 108 is supported on a feed guide 112 extending towards the media inlet.

In this example, the feed guide 112 is mounted to the first side 110 of the sheet media processing machine 100 so that an upper surface 116 of the feed guide terminates at the media inlet 102 to guide sheet media 114 directly into the media inlet 102. The feed guide 112 extends laterally away from the first side 110 of the media processing machine. Further, in this particular example the feed guide 112 is inclined downwardly away from the media inlet 102, such that its angle of inclination with respect to the horizontal in use may be similar to the angle of inclination of a feed portion of sheet media 114 overlying the feed guide 112 which drapes over the distal edge 118 of the feed guide 112, such as between 10 and 30 degrees below the horizontal.

In this particular example, the re-feed prevention element 108 comprises an elastomer overmolding on the distal end of the feed guide 112, and extends along the full width of the feed guide 112, which is substantially the same width as the media inlet 102 (FIG. 2). In this example, the feed guide 112 extends approximately 15 cm from the media inlet 102 along the feed direction so that the re-feed prevention element 108 is spaced approximately 15 cm away from the media inlet 102 along the feed direction. In other examples, the feed guide 112 may be of other sizes and the re-feed prevention element may be spaced apart from the media inlet by a different distance, such as 40 cm or less, 30 cm or less, 20 cm or less, or 10 cm or less. The spacing may be 2 cm or more, 5 cm or more, or 10 cm or more. In this example, the re-feed prevention element has an extent along the feed direction of approximately 3 cm so that it covers a tip portion of the feed guide 112 and is exposed on an external surface of the feed guide 112. In other examples, the re-feed prevention element may be set back from a tip or distal end of a feed guide, for example, a re-feed prevention element may be disposed part way between the proximal and distal ends of a feed guide on the upper surface of the feed guide.

In other examples the re-feed prevention element 108 may not be provided on a feed guide, for example, the re-feed prevention element may be provided on a support extending from the sheet media processing machine which is not a feed guide, for example, a retractable or pivotable support extending from a recess located mid-way between the media inlet 102 and the media outlet 104.

Further, in other examples the re-feed prevention element 108 may be formed in any suitable way so that it is exposed to contact with sheet media. For example, the re-feed prevention element may be a discrete elastomeric element partially embedded in a feed guide or support to which it is coupled, for example, by way of protrusions that are received in recesses within the feed guide or support. Further, the re-feed prevention element may be a heat shrink tube located and formed around a support member, such as a bar, of a feed guide or support. Yet further, the re-feed prevention element may comprise an elastomeric coating on a feed guide or support to form an external surface of the feed guide or support.

The feed mechanism 106 extends from the media inlet 102 to the media outlet 104 and defines a media pathway 120 through the sheet media processing machine 100. In this example, the feed mechanism 106 comprises a plurality of pairs of feed rollers 122, including a pair of feed rollers 122 located adjacent the media inlet 102 and a pair of feed rollers 122 located part way along the media pathway 120. The feed mechanism 106 has guide walls 123 to guide the sheet media 114 along the media pathway 120, which has a C-shape through the machine 100.

In this example, the feed mechanism 106 defines a media pathway through the machine by which the sheet media is substantially turned over, such that a side of sheet media 114 that is face-up when it is received at the media inlet 102 is face-down when it is discharged from the media outlet 104. The feed mechanism 106 conveys the sheet media past processing units of the media processing machine, such as scanner units and/or printing units.

The sheet media processing machine 100 is suitable for receiving sheet media of different types, for example paper, cardboard, plastics or the like, which may be relatively flexible. Further, the sheet media processing machine 100 is suitable for receiving sheet media of different sizes and lengths, for example standard media sizes such as A4, A3, A2, A1 having corresponding standard lengths, and also long plots, which may have a length of 1-2 m or longer (around 40-80 inches).

In an example method of use of the sheet media processing machine 100, a user loads long plot sheet media 114 so that an end of the sheet media 114 is fed into the media inlet 102. The portion of sheet media 114 upstream of the media inlet is referred to as a feed portion of sheet media 114. The feed portion of sheet media 114 extends towards the media inlet so that it drapes over the re-feed prevention element 108 owing to gravity.

The feed mechanism 106 activates the feed rollers 122 to draw the sheet media 114 through the sheet media processing machine along the media pathway 120. A discharge portion of the long plot sheet media 114 is discharged from the media outlet 104 whilst a feed portion of the same piece of long plot sheet media 114 is still being fed towards the media inlet 102 and draped over the re-feed prevention element 108.

In this example, the sheet media 114 curls upwards upon discharge from the media outlet 104, for example, owing to heating along the media pathway or a pre-existing curl. Further, the sheet media 114 is sufficiently stiff that it does not fall away from the media inlet 102 when discharged. Accordingly, the end of the discharge portion of sheet media 114 is driven towards the feed portion of sheet media 114 and makes contact with the feed portion. Friction between the underside of the feed portion of sheet media 14 and the end of the discharge portion of sheet media 114 causes the end of the discharge portion to be drawn along with the feed portion towards the media inlet 102 and the re-feed prevention element 108. This causes the side of the discharge portion which was face-down at the media outlet 104 to curl around so that it contacts the underside of the feed portion of sheet media 114.

As the feed portion of sheet media 114 moves towards the media inlet 102 it rides (or slides) over the re-feed prevention element 108, and draws the discharge portion of sheet media towards the re-feed prevention element 108 so that the end of the discharge portion of sheet media abuts the re-feed prevention element 108.

Friction between the re-feed prevention element 108 and the discharge portion of sheet media 114 is greater than friction between the discharge portion and feed portion of sheet media 114. The friction force may be influenced by the combined weight of the discharge portion and the feed portion of sheet media that may be supported on the re-feed prevention element. Accordingly, as the feed mechanism 106 continues to draw the feed portion of sheet media 114 into the media inlet 102, the feed portion slides over the discharge portion in preference to the discharge portion sliding over the re-feed prevention element 108. Consequently, the discharge portion of sheet media 114 is arrested at the re-feed prevention element 108.

As the feed mechanism 106 continues to discharge sheet media 114 from the outlet, the discharge portion of sheet media 114 grows until its weight overcomes the curling effect, at which point the discharge portion falls downwardly away from the re-feed prevention element 108.

Figure 3:
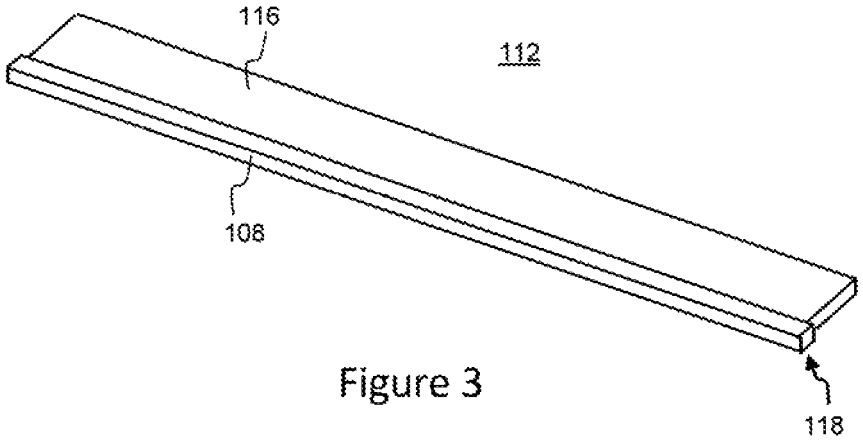
FIGS. 3 to 5 are simplified schematics of example feed guides for a sheet media processing machine.

FIG. 3 shows the example feed guide 112 for the sheet media processing machine 100 of FIGS. 1 and 2, including the re-feed prevention element 108 provided at the distal edge of the feed guide 112. The feed guide 112, including the re-feed prevention element 108, can be provided separately from the sheet media processing machine 100, for example, so that it may be retrofitted to a sheet media processing machine 100 to inhibit recirculation of sheet media. The feed guide 112 may be secured to a sheet media processing machine 100 by any suitable means, for example, the feed guide 112 may have attachment portions to attach to corresponding attachment portions on the sheet media processing machine 100, such as locking tabs, projections or a groove. In other examples, the feed guide 112 may be secured to the sheet media processing machine 100 by a mechanical fastener such as a bolt or screw.

Figure 4:
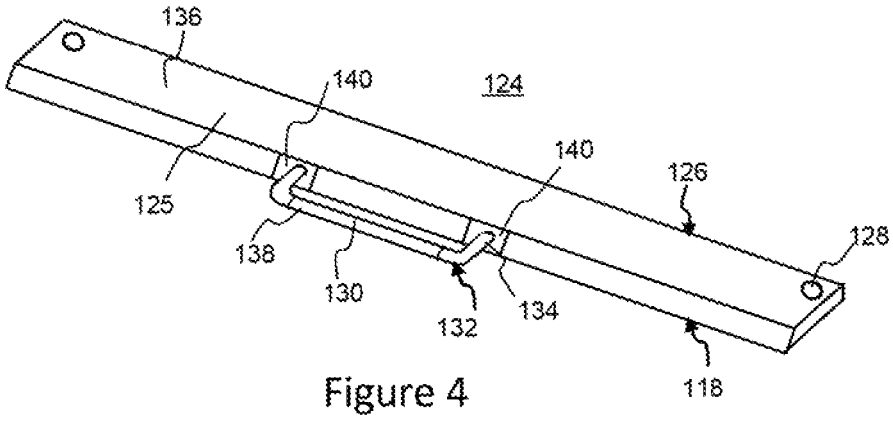
Figure 5:
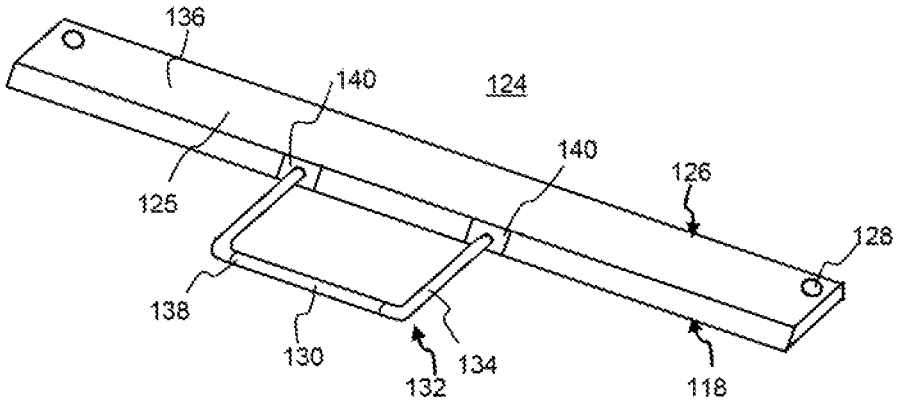

FIGS. 4 and 5 show a further example feed guide 124 including a re-feed prevention element 130. In this example, the feed guide 124 is in the form of an elongate member or feed guide body 125 which can be attached to a sheet media processing machine 100 at its proximal edge 126 (i.e. the edge adjacent the machine in use), as described above. In this particular example, the feed guide 124 is provided with countersunk through-holes 128 at either lateral ends of its proximal edge 126, through which bolts or screws can be inserted to engage corresponding threaded holes adjacent the media inlet 102 of the sheet media processing machine.

The re-feed prevention element 130 is provided on a support 132 extendable from the feed guide body 125. The support 132 is shown in a retracted configuration in FIG. 4 and an extended configuration in FIG. 5. The support 132 is in the form of a U-shape bar having two parallel arms 134 that extend in a plane substantially parallel to an upper surface 136 of the feed guide. The feed guide upper surface 136 of the feed guide 124 is inclined approximately 20° below the horizontal when the feed guide 124 is attached to a media processing machine 100. The two parallel arms 134 extend in a direction substantially normal to the distal edge of the upper surface 136. The distal ends of the arms 134 are connected by a lateral bar portion 138 extending between them and parallel with the distal edge of the feed guide body 125.

In this particular example, the feed guide body 125 is hollow and may be formed of extruded aluminium or steel having a hollow cross-section. The proximal ends of the parallel arms 134 extend through port covers 140 in the distal edge 118 of the feed guide body 125. The port covers 140 allow sliding movement of the support 132 relative the feed guide body 125 between the retracted and extended configurations along an extension direction parallel with the arms 134. The proximal ends of the arms 134 are provided with retaining elements within the hollow cross-section of the feed guide body 125 to inhibit inadvertently separating the support 132 from the feed guide body 125. The feed guide body 125 may be provided with internal detents to engage with corresponding formations on the support 132 (such as a groove) to locate the support 132 in the retracted and/or extended configurations. The detent or detents may be released by the application of a retracting or extending force (i.e. by pushing or pulling on the support 132). The retracting force to release the detent(s) and retract the support from the extended configuration may be greater than the force experienced by the re-feed prevention element and support owing to a discharge portion of sheet media abutting the re-feed prevention element.

The port covers 140 fit within corresponding slots machined in the feed guide body 125, and each may include a guide duct corresponding to the cross-section of the respective arm 134 to inhibit play (i.e. relative movement away from the extension direction) between the support 132 and the feed guide body 125.

In this example, the U-shape bar is a metal bar, for example stainless steel, and the re-feed prevention element 130 comprises a heat shrink elastomer tube formed on the bar (i.e. before the bar is assembled into the feed guide body 125). In this particular example, the tube is formed of silicone rubber. In other examples, the re-feed prevention element 130 may take other forms, for example it may be partially embedded in the support 132, or may be formed as a coating on the support 132.

As shown in FIGS. 4 and 5, the width of the support 132 and re-feed prevention element 130 is less than the width of the feed guide 124 (and so a media inlet to which the feed guide 124 corresponds), and is disposed at a central lateral location on the feed guide 124. The central location may prevent a discharged portion of sheet media turning or pivoting around the re-feed prevention element 130 in use.

Further, in the example shown in FIGS. 4 and 5, the feed guide 124 has a width corresponding to the short side of an A1 sheet of media (594 mm), whereas the width of the support 132 and the re-feed prevention element 130 is approximately 190 mm wide, which is approximately 30% of the width of the sheet media. The applicant has found this width to be more than sufficient for preventing re-feed of a discharged portion of paper for sizes including A1 sheets. Re-feed prevention elements having a width of less than 30% of the corresponding feed guide 124 may be equally effective in preventing re-feed of sheet media that is the same width as the feed guide 124. In particular, in this example, the width of 190 mm is considered to be substantially more than a minimum width to prevent re-feed, and this width is selected to prevent the side portions of sheet media to the left and right of the support 132 and re-feed prevention element 130 from sagging and causing folds or marks in the sheet media, rather than for providing sufficient friction force to prevent re-feed.

In other examples, a re-feed prevention element may be 10% or more, 20% or more, 30% or more of the width of a corresponding feed guide 124, and may be 100% or less, 75% or less or 50% or less than the width of a corresponding feed guide 124.

Figure 6:
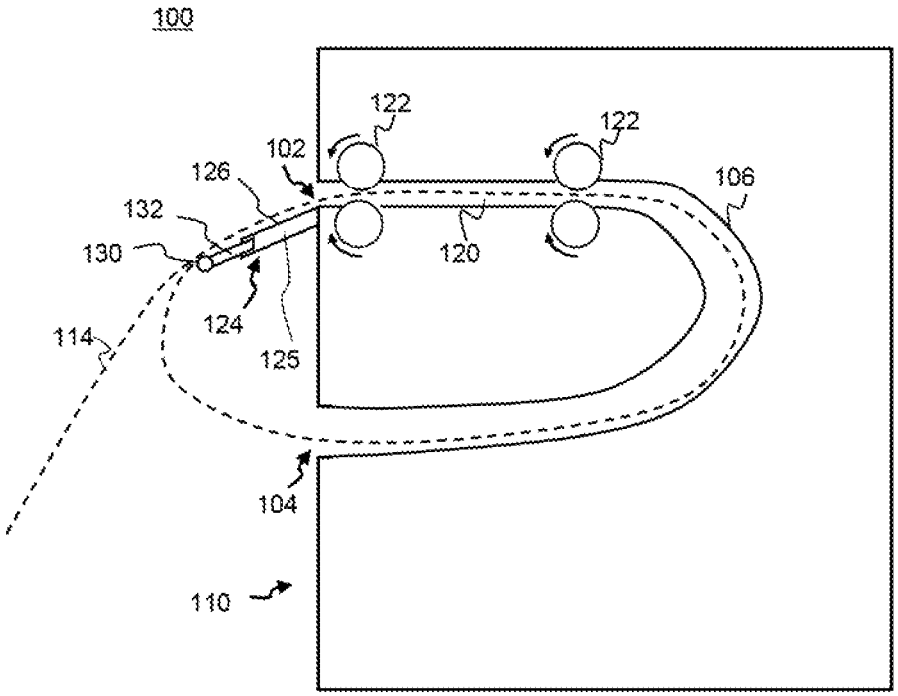
FIGS. 6 and 7 are simplified schematics of a further example sheet media processing machine.
Figure 7:
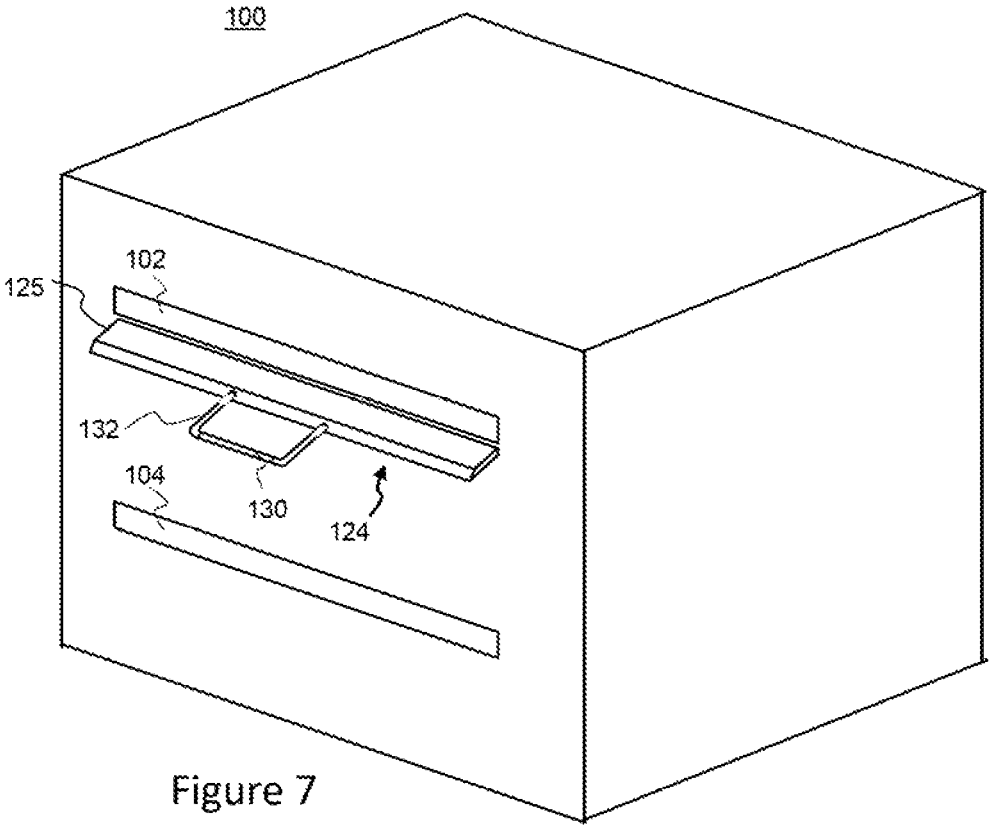

The feed guide 124 (including the support 132 and re-feed prevention element 130) can be installed on a sheet media processing machine 100 substantially as described above with respect to FIGS. 1 and 2 (i.e. in place of the feed guide 112). FIGS. 6 and 7 show the feed guide 124 installed on a sheet media processing machine 100.

In an example method of use, the feed guide 124 may be attached to a sheet media processing machine 100 as shown in FIGS. 6 and 7. If the support 132 is stowed in the retracted configuration, it may be extended to the extended configuration by pulling the support 132 or re-feed prevention element 130 for use. In this example, when attached to the sheet media processing machine 100, the re-feed prevention element 130 can be extended from a separation of approximately 8 cm from the media inlet 102 to a separation of approximately 14 cm from the media inlet 102 with respect to the feed direction. In other examples the re-feed prevention element may be extendible over a greater or shorter distance, for example between 2 cm and 20 cm of extension relative the feed guide body 125. Further, in other examples the feed guide 124 may be shorter or longer along the feed direction, for example between 5 cm and 40 cm.

Sheet media 114 is provided to the media inlet 102 and drawn through the feed mechanism 106 as described above with respect to FIGS. 1 and 2. When the discharge portion of the sheet media 114 curls towards the media inlet 102 and is drawn into abutment with the re-feed prevention element 130, the friction between the discharge portion of the sheet media 114 and the re-feed prevention element 130 is greater than the friction between the discharge portion of the sheet media 114 and the feed portion of the sheet media 114. Accordingly, the feed portion of the sheet media 114 is drawn to slide over the discharge portion of the sheet media 114 and the discharge portion is arrested at the re-feed prevention element 130.

Figure 8:
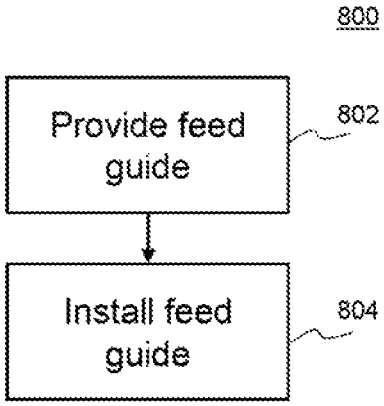
FIG. 8 is a flowchart of an example of a method including installing a feed guide on a sheet media processing machine.

FIG. 8 is a flowchart setting out an example of a method 800. In block 802, a feed guide comprising a re-feed prevention element is provided, the re-feed prevention element comprising an elastomer. In block 804, the feed guide is installed on a sheet media processing machine. The sheet media processing machine comprises a media inlet 102 to receive sheet media along a feed direction from a first side of the machine, and a media outlet 104 to discharge sheet media along a discharge direction towards the first side of the machine, such that there is an external recirculation path along which discharged sheet media can curl towards the media inlet. The media inlet 102, media outlet and feed mechanism may have any combination of the features described above with respect to the sheet media processing machine of FIGS. 1, 2. 6 and 7. The feed guide is installed on the sheet media processing machine to guide sheet media along a feed direction towards the media inlet of the machine, and so that the re-feed prevention element is disposed upstream of the media inlet relative the feed direction and exposed to contact with sheet media.

The feed guide may have any combination of the features described above by reference to the feed guide 112 of FIGS. 1 to 3, and by reference to the feed guide 124 of FIGS. 4 to 7.

In a further example method, prior to installation of the feed guide in block 804, the sheet media processing machine may comprise a feed guide without a re-feed prevention element comprising an elastomer. Accordingly, the method may additionally comprise removing the pre-existing feed guide, before installing the feed guide including a re-feed prevention element comprising an elastomer.

In some examples, there may be a plurality of discrete re-feed prevention elements, for example, arranged side-by-side along a lateral axis.

Although examples have been described in which a retractable or extendable support and re-feed prevention element are extended to an extended configuration for use, the re-feed prevention element may be effective in arresting a discharge portion of sheet media and preventing recirculation in the retracted configuration and any position therebetween. Extension may help to avoid recirculation since a discharge portion of sheet media may be more prone to sagging or falling away from an inlet due to gravity.

Where a feed guide is provided, the feed guide body may be non-elastomeric, and/or may comprise a material selected so that friction between the feed guide body and sheet media is less than friction between two portions of sheet media, when the sheet media comprises paper or card. For example, the feed guide body may comprise aluminium, steel or a rigid plastics material.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and alternative implementations may be designed without departing from the scope of the appended claims. Features described in relation to one example may be combined with features of another example. Features described in relation to one example may be combined with features of another example. In particular, a feed guide and re-feed prevention member may have any combination of the features of the feed guide and re-feed prevention members described with respect to FIGS. 1-7.

The word "comprising" does not exclude the presence of elements other than those listed in a claim, "a" or "an" does not exclude a plurality.

The features of any dependent claim may be combined with the features of any of the independent claims or other dependent claims.

The invention claimed is:

1. A sheet media processing machine comprising:

a media inlet to receive sheet media along a feed direction from a first side of the machine;

a media outlet to discharge sheet media along a discharge direction towards the first side of the machine;

a feed mechanism to convey sheet media from the media inlet to the media outlet; and a re-feed prevention element disposed upstream of the media inlet with respect to the feed direction and coupled to a support to inhibit recirculation of discharged sheet media along an external recirculation path between the media outlet and the media inlet, the re-feed prevention element being exposed to contact sheet media and comprising an elastomer, wherein the support is moveable between a stowed configuration and an extended configuration, wherein the spacing between the re-feed prevention element and the media inlet increases as the support is moved from the stowed configuration to the extended configuration.

2. A sheet media processing machine according to claim 1, wherein the re-feed prevention element has a width less than a width of the media inlet.

3. A sheet media processing machine according to claim 1, further comprising a feed guide to guide sheet media along the feed direction to the media inlet, and wherein the support is coupled to the feed guide of the machine.

4. A sheet media processing machine according to claim 3, wherein:

the support is moveable between a stowed configuration and an extended configuration;

the support is at least partly disposed within the feed guide in the stowed configuration; and the spacing between the re-feed prevention element and the media inlet increases as the support is moved from the stowed configuration to the extended configuration.

5. A sheet media processing machine according to claim 1, wherein the re-feed prevention element is in the form of an elastomeric coating, overmolded layer or heat shrink tube on the support.

6. A sheet media processing machine according to claim 1, wherein the re-feed prevention element comprises rubber.

7. A sheet media processing machine according to claim 1, wherein the re-feed prevention element is substantially parallel with the media inlet.

8. A sheet media processing machine according to claim 1, further comprising a feed guide to guide sheet media along the feed direction to the media inlet, and wherein the re-feed prevention element is coupled to the feed guide.

9. A sheet media processing machine according to claim 8, wherein the re-feed prevention element is provided at the distal end of the feed guide.

10. A sheet media processing machine according to claim 1, wherein the sheet media processing machine is a printer, scanner or photocopier.

11. A feed guide for a sheet media processing machine, the feed guide being installable to guide sheet media along a feed direction towards a media inlet of the machine and comprising:

a re-feed prevention element to inhibit recirculation of discharged sheet media in use, the re-feed prevention element being exposed to contact sheet media and comprising an elastomer, wherein the re-feed prevention element is coupled to a support being moveable between a stowed configuration and an extended configuration, wherein the spacing between the re-feed prevention and the media inlet increases as the support is moved from the stowed configuration to the extended configuration.

12. A method comprising:

providing a feed guide comprising a re-feed prevention element, the re-feed prevention element comprising an elastomer; and installing the feed guide on a sheet media processing machine, the sheet media processing machine comprising:

a media inlet to receive sheet media along a feed direction from a first side of the machine;

a media outlet to discharge sheet media along a discharge direction towards the first side of the machine; and a feed mechanism to convey sheet media from the media inlet to the media outlet;

wherein the feed guide is installed to guide sheet media along a feed direction towards the media inlet of the machine, and wherein the re-feed prevention element is disposed upstream of the media inlet relative the feed direction and coupled to a support to inhibit recirculation of discharged sheet media along an external recirculation path between the media outlet and the media inlet, the re-feed prevention element being exposed to contact sheet media, wherein the support is moveable between a stowed configuration and an extended configuration, wherein the spacing between the re-feed prevention element and the media inlet increases as the support is moved from the stowed configuration to the extended configuration.

* * * * *